US006741817B2

(12) United States Patent
Seto

(10) Patent No.: US 6,741,817 B2
(45) Date of Patent: May 25, 2004

(54) PERIPHERAL DEVICE FOR IMAGE FORMING APPARATUS, IMAGE FORMING APPARATUS, IMAGE FORMING SYSTEM AND ITS CONTROL METHOD

(75) Inventor: Tsuyoshi Seto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/273,120

(22) Filed: Oct. 18, 2002

(65) Prior Publication Data

US 2004/0076445 A1 Apr. 22, 2004

(51) Int. Cl.[7] ..... G03G 15/00; G03G 21/14
(52) U.S. Cl. ..... 399/75; 399/76; 399/82
(58) Field of Search ..... 399/75–77, 381, 399/407, 82

(56) References Cited

U.S. PATENT DOCUMENTS 5,363,175 A 11/1994 Matysek
6,226,471 B1 * 5/2001 Tsuzuki ..... 399/75
6,241,404 B1 * 6/2001 Fietze et al. ..... 399/76

FOREIGN PATENT DOCUMENTS

JP 1-159664 U 11/1989
JP 5-41991 B2 6/1993
JP 11-208979 8/1999

* cited by examiner

*Primary Examiner*—William J. Royer
(74) *Attorney, Agent, or Firm*—Morgan Lewis & Bockius LLP

(57) ABSTRACT

An image forming apparatus judges whether first processing information of current sheet information is different from that of preceding sheet information. If they are different, the current first processing information is notified to a finishing device. The finishing device prepares for processing based on the first processing information. Upon completing the preparation, the finishing device notifies preparation completion information to the image processing apparatus. Upon receiving the preparation completion information, the image processing apparatus starts image formation processing on the next sheet and notifies second processing information to the finishing device. Upon receiving the second processing information, the finishing device calculates a processing time necessary to perform a finishing operation and notifies it to the image forming apparatus. Since the finishing device manages its restrictive condition, it becomes possible to combine the image forming apparatus and the finishing device freely as well as to maximize the productivity of each.

18 Claims, 12 Drawing Sheets

PERIPHERAL DEVICE FOR IMAGE FORMING APPARATUS, IMAGE FORMING APPARATUS, IMAGE FORMING SYSTEM AND ITS CONTROL METHOD

BACKGROUND OF THE INVENTION

1. Field of the Invention

The present invention relates to an image forming system as a combination of an image forming apparatus and a peripheral device. For example, the invention relates to the control on a finishing device and an image forming apparatus.

2. Description of the Related Art

A finishing device of the above kind is to perform a finishing operation such as stapling and punching on a set of sheets or an individual sheet on which an image has been formed by an image forming apparatus. The image forming apparatus and the finishing device perform different kinds of processing and hence they are sometimes different from each other in productivity. As disclosed in JP-B-5-41991, an image forming system is known in which the productivity of the finishing device increased by providing plural compiler trays for setting processing and using the compiler trays cyclically (or alternately). Even if the productivity of the finishing device is increased in this manner, it is difficult to equalize it with the productivity of the image forming apparatus. In general, the image forming apparatus has higher productivity than the finishing device. If this is the case, time-related restrictions occur to enable a finishing operation; for example, to secure proper operation of the finishing device, the interval of an image forming operation of the image forming apparatus is adjusted.

However, since the restrictive conditions of the finishing device are not fixed, it is necessary to change an image forming operation of the image forming apparatus in accordance with the restrictive conditions of the finishing device. Several inventions and proposals have been made to avoid such restrictions. For example, JP-UM-A-1-159664 discloses a technique that the number of sheets that are fed to a finishing device is counted, and if the count exceeds the number of sheets of a set, the inter-set waiting time in an image forming operation of an image forming apparatus is elongated because the finishing operation should take a long time in this case. In this conventional example, the inter-set waiting time is set originally in the image forming apparatus. It is therefore necessary to change setting of the image forming apparatus if the finishing device is switched. This publication discloses only adjusting the waiting time of an image forming operation on the basis of the one restrictive condition, that is, the number of sheets for one kind of finishing operation; no consideration is given to a case involving plural restrictive conditions.

JP-A-11-208979 discloses a technique that a processing time necessary for a finishing operation on one set is acquired from a finishing device at the time of power application and the sheet feed interval is adjusted in accordance with the acquired processing time. According to this conventional example, since a processing time necessary for the finishing operation is acquired from the finishing device, adaptation to a new finishing device can be made by acquiring a processing time necessary for it even when the finishing operation is changed. However, this publication discloses only acquiring a processing time of inter-set processing from the finishing device at the time of power application, and gives no disclosures as to how to deal with a case in which an image formation processing interval other than the inter-process interval is necessary such as a case in which the image forming apparatus has a shorter sheet processing interval than the finishing device. Further, the only restrictive condition that is described in this publication is the one relating to stapling.

Finishing devices are now required to have an increasingly large number of functions such as stapling, punching, binding, and folding and the number of restrictive conditions is increasing accordingly. The number of combinations of restrictive conditions will become enormous. Therefore, it is becoming difficult to give, originally or in response to a notice that is supplied at the time of power application, an image forming apparatus information that enables it to manage even a combination of restrictive conditions as in the above conventional examples. This situation, which has been described above in connection with finishing devices, is also true of combinations of an image forming apparatus and peripheral devices such as a document reading device and a sheet feeder.

SUMMARY OF THE INVENTION

The present invention has been made in view of the above circumstances, and provides a system capable of flexibly adapting to various restrictive conditions resulting from a difference in productivity between an image forming apparatus and a peripheral device so as to enable maximum use of the productivity of each.

Therefore, according to the invention, in contrast to the conventional case in which the judgment and management relating to a restriction resulting from the peripheral device are performed by the image forming apparatus, the judgment and management relating to a restriction resulting from the peripheral device are performed by the peripheral device itself. Control is performed in such a manner that the peripheral device and the image forming apparatus communicate with each other.

More specifically, the image forming apparatus notifies, to the peripheral device, information that is necessary for the peripheral device to perform a processing control. The peripheral device generates information relating to a processing time that is necessary in the peripheral device on the basis of the received information, and notifies the generated information to the image forming apparatus. The image forming apparatus performs scheduling of its image forming operation on the basis of the received information relating to the processing time.

BRIEF DESCRIPTION OF THE DRAWINGS

Preferred embodiments of the present invention will be described in detail based on the following figures, wherein.

DETAILED DESCRIPTION

Figure 1:
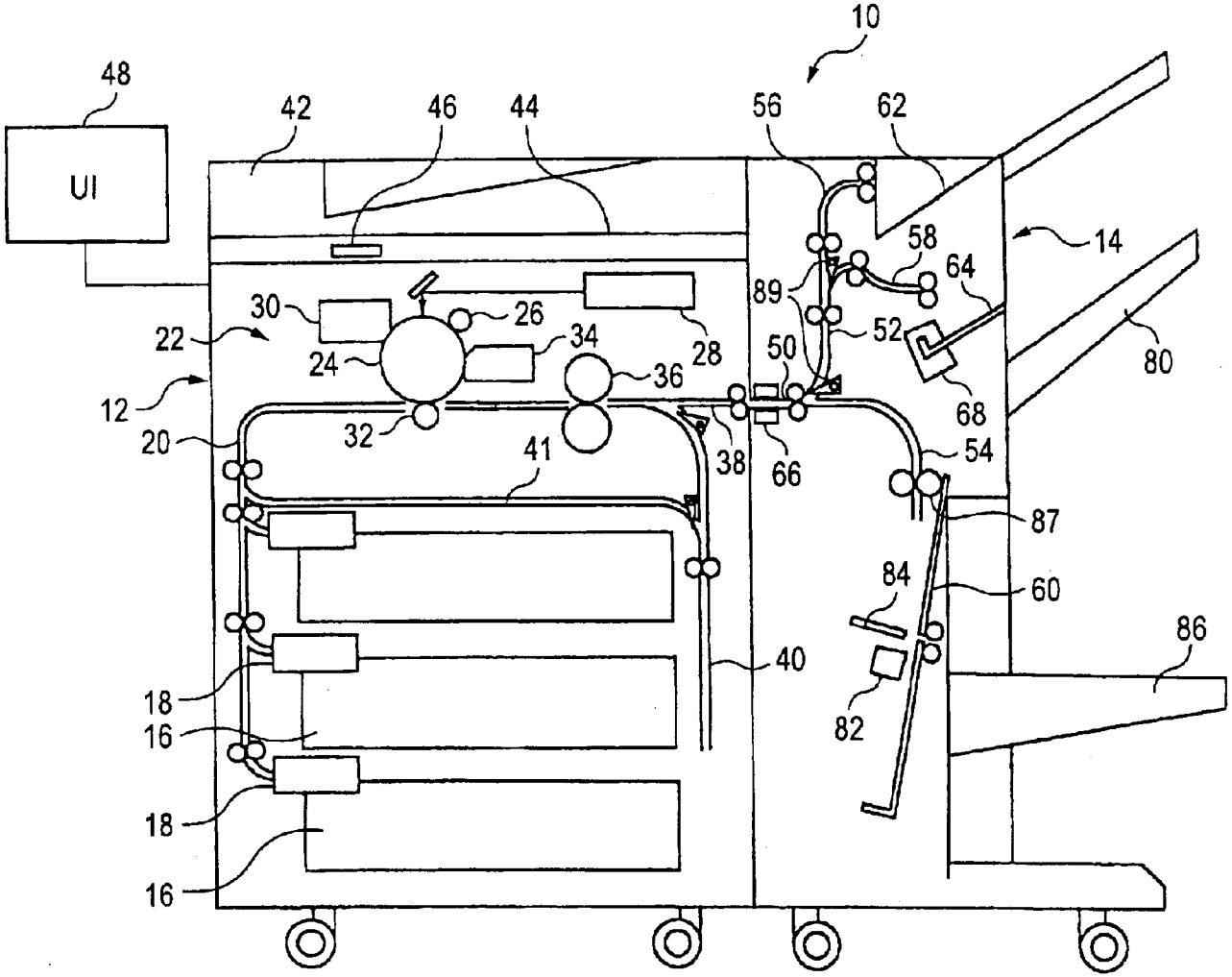
FIG. 1 is a side view showing an image forming system according to an embodiment of the invention.

A first aspect of the invention provides a peripheral device to be connected to an image forming apparatus, including a receiving unit for receiving, from the image forming apparatus, information that is necessary for the peripheral device to perform a processing control; an information generating unit for generating information relating to a processing time of the peripheral device on the basis of the information received by the receiving unit; and a notifying unit for notifying the information generated by the information generating unit to the image forming apparatus. That is, information that is necessary for the peripheral device to perform a processing control is passed from the image forming apparatus to the peripheral device, and the peripheral device generates information relating to a processing time of the peripheral device and notifies it to the image forming apparatus. Therefore, the image forming apparatus can control the timing of an image formation control on the basis of the received processing time of the peripheral device. The image forming apparatus need not hold information relating to a restriction resulting from the peripheral device.

The invention is particularly effective if the peripheral device is a finishing device. In the finishing device, the information generating unit generates information relating to time that will be taken until reception of the sheet becomes possible. The peripheral device may be such that the receiving unit receives information relating to a first sheet on which image formation will be performed, and that the information generating unit generates information that is necessary for an image forming operation on a second sheet that will be subjected to image formation following the first sheet. Since information that is necessary for an image forming operation on a second sheet is generated on the basis of information relating to a first sheet that is preceding the second sheet, it is possible to, for example, generate information necessary for an image formation operation on the second sheet and notify it to the image forming apparatus before acquisition of information of the second sheet. This makes it unnecessary for the finishing device and the image forming apparatus to communicate with each other at a high speed.

The peripheral device may separately receive first processing information that is necessary for the peripheral device to prepare for a finishing operation and second processing information that is necessary for the peripheral device to perform the finishing operation and that excludes the first processing information, generate information that is necessary for an image formation control in accordance with each received information, and notify it to the image forming apparatus. The finishing device prepares for the finishing operation on the basis of the first processing information and notifies preparation completion information indicating completion of the preparation to the image forming apparatus. It is difficult to predict time that will be taken to prepare for the finishing operation. Making preparation actually and notifying its completion information make it possible to assure an operation of the finishing device reliably.

The finishing device may receive second processing information, generate information relating to a processing time, and notify it to the image forming apparatus. A processing time of the finishing operation is predictable and can be determined in accordance with the performance of the finishing device. By notifying a processing time to the image forming apparatus, scheduling of an image forming operation of the image forming apparatus can be made earlier.

A second aspect of the invention provides an image forming apparatus to which a peripheral device is to be connected, including a notifying unit for notifying, to the peripheral device, information that is necessary for the peripheral device to perform a processing control; a receiving unit for receiving information relating to a processing time of the peripheral device that has been generated on the basis of the information notified by the notifying unit; and a control unit for controlling an image forming operation on the basis of the information received by the receiving unit. Since the peripheral device generates information relating to its processing time, the image forming apparatus is required to only wait for sending of information from the peripheral device and then control an image forming operation. Where information is notified to the peripheral device sheet by sheet, the image forming apparatus may monitor a change in the information sheet by sheet and to select information to be notified in accordance with a monitoring result. Second sheet information is compared with first sheet information. If a change has occurred in first processing information that is necessary for preparation of the peripheral device, the image forming apparatus instructs the peripheral device to make preparation. If no change has occurred in the first processing information, the image forming apparatus notifies only second processing information to the peripheral device. The communication between the image forming apparatus and the peripheral device can be simplified in this manner.

A third aspect of the invention provides an image forming system having an image forming apparatus for performing image formation on a sheet and a peripheral device connected to the image forming apparatus, including a first communicating unit for sending information that is necessary for the peripheral device to perform a processing control from the image forming apparatus to the peripheral device; an information generating unit, provided in the peripheral device, for generating information relating to a processing time of the peripheral device on the basis of the received information; a second communicating unit for sending information generated by the information generating unit from the peripheral device to the image forming apparatus; and a control unit, provided in the image forming apparatus, for controlling an image forming operation on the basis of the received information. That is, the first communicating unit allows information that is necessary for the peripheral device to perform a processing control to be sent from the image forming apparatus and received by the peripheral device, the information generating unit of the peripheral device generates information relating to a processing time of the peripheral device, the second communicating unit allows this information to be sent from the peripheral device and received by the image forming apparatus, and the control unit of the image forming apparatus controls an image forming operation on the basis of this information. Therefore, the judgment and management relating to a restriction resulting from the peripheral device can be performed by the peripheral device. The image forming apparatus is required to only receive information relating to the restriction and control an image forming operation.

A fourth aspect of the invention provides a control method of an image forming system having an image forming apparatus for performing image formation on a sheet and a peripheral device connected to the image forming apparatus, including the steps of sending, from the image forming apparatus to the peripheral device, information that is necessary for the peripheral device to perform processing; generating information relating to a processing time of the peripheral device on the basis of the information sent to the peripheral device; sending the generated information from the peripheral device to the image forming apparatus; and controlling an image forming operation on the basis of the information sent to the image forming apparatus. Since information necessary for a processing control in the peripheral device and information necessary for an image formation control can be acquired by a mutual communication between the image forming apparatus and the peripheral device, maximum productivity can be secured even if the combination of the image forming apparatus and the peripheral device is changed.

Embodiments of the present invention will be hereinafter described with reference to the accompanying drawings.

As shown in FIG. 1, an image forming system 10 is composed of an image forming apparatus 12 and a finishing device 14. For example, the image forming apparatus 12 has three-stage sheet feed trays 16 that are equipped with respective feed heads 18. If one of the sheet feed trays 16 is selected, its feed head 18 starts operating, whereby a sheet is fed from the selected sheet fed tray 16 to a print engine 22 via a sheet feed path 20.

The print engine 22 operates according to the xerography, for example, and has a photoreceptor 24, a charging roll 26 for charging the surface of the photoreceptor 24 uniformly, a laser writing device 28 for writing a latent image on the photoreceptor 24, a developing device 30 for developing a toner image on the photoreceptor 24, a transfer roll 32 for transferring the developed toner image to a sheet, a cleaner 34 for removing residual toner, and a fusing device 36 for fusing the toner image on the sheet. The surface of the photoreceptor 24 is charged uniformly by the charging roll 26, and a latent image is formed by the laser writing device 28 and developed into a toner image by the developing device 30. The toner image is transferred to a sheet by the transfer roll 32 and fused on the sheet by the fusing device 36. The sheet is transported through a sheet ejection path 38 and ejected to the finishing device 14.

Where double-sided printing is set, the sheet on which the toner image is fused on one surface by the fusing device 36 is sent to an inverting device 40 via the sheet ejection path 38 and inverted by the inverting device 40. The inverted sheet is sent to a sheet inversion path 41 and then returned to the sheet feed path 20. The sheet is sent to the print engine 22, where printing is performed on the other surface.

The image forming apparatus 12 has an automatic document feeding device 42 such as an ADF. The automatic document feeding device 42 feeds a document to a platen 44. An image of the document located on the platen 44 is read by a scanner 46. A user interface device 48 is integral with the image forming apparatus 12 or is connected to the image forming apparatus 12 via a network. A content of processing to be performed by each of the image forming apparatus 12 and the finishing device 14 is selected through and displayed on the user interface device 48.

The finishing device 14 has a first sheet path 50 that is connected to the sheet ejection path 38 of the image forming apparatus 12, a second sheet path 52 and a third sheet path 54 that branch off from the first sheet path 50, and a fourth sheet path 56 and a fifth sheet path 58 that branch off from the second sheet path 52. The third sheet path 54 is connected to a saddle stapling tray 60, the fourth sheet path 56 is connected to a top tray 62, and the fifth sheet path 58 is connected to a compiler tray 64.

A puncher 66 is provided adjacent to the first sheet path 50. A sheet going through the first sheet path 50 is stopped temporarily, and the puncher 66 is moved in accordance with the width of the sheet to be punched and positions of holes to be formed and forms a prescribed number (two, three, four, or the like) of holes at the prescribed positions of the sheet.

Figure 2:
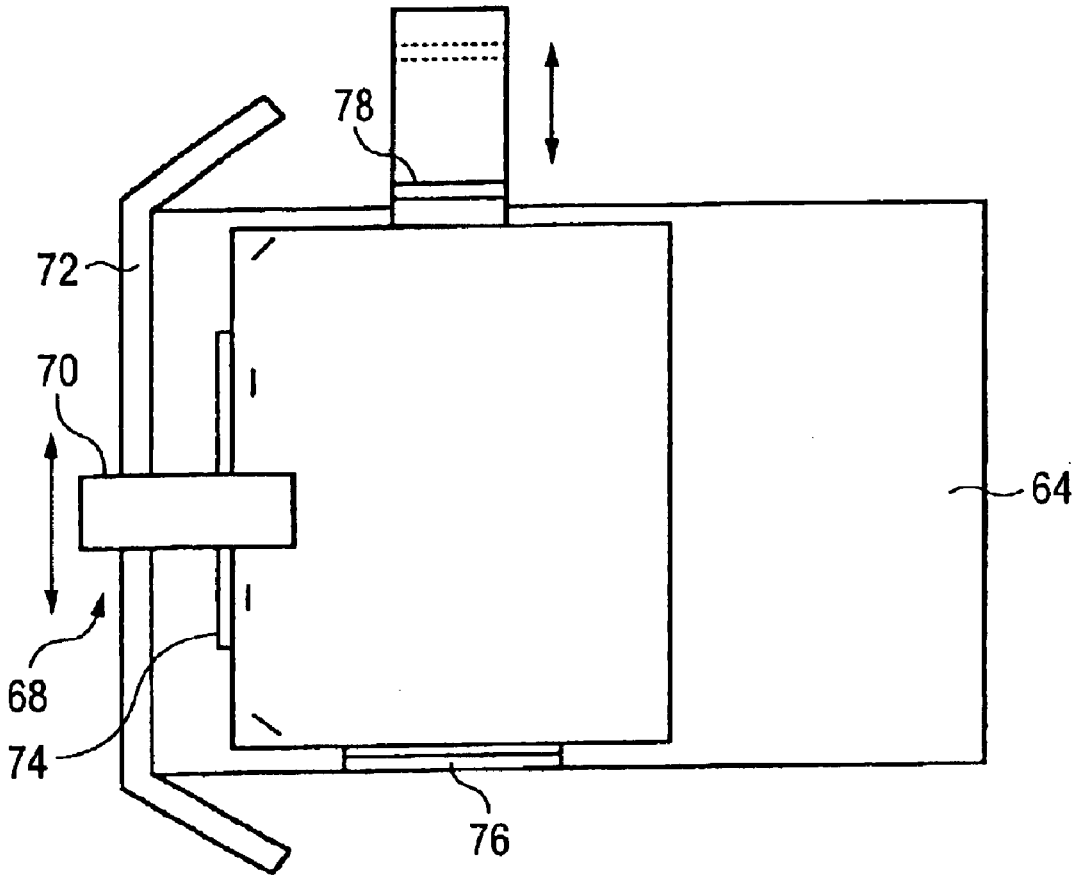
FIG. 2 is a plan view of a stapler that is used in a finishing device according to the embodiment of the invention.

A stapler 68 is provided in the compiler tray 64. As shown in FIG. 2, the stapler 68 has a stapler main body 70 and a guide 72 that is provided so as to make the stapler main body 70 movable in the right-left direction at the rear end of the compiler tray 64. Incorporating staples, the stapler main body 70 moves along the guide 72 and drives a prescribed number (front, rear, dual, or the like) of staples into sheets at prescribed positions. The compiler tray 64 has a rear fence 74 that the rear ends of sheets are to touch and a side fence 76 that one sides of the sheets are to touch. The compiler tray 64 is also equipped with a tamper 78 on the other side. Sheets that are stacked in the compiler tray 64 are tampered by the tamper 78 and thereby set flush with each other. The home position of the tamper 78 is set for each sheet width and the tamper 78 is moved in the right-left direction in accordance with the sheet width. Stapled sheets are ejected as a set from the compiler tray 64 to a first stacker tray 80.

A saddle stapler 82 is provided at a central position of the saddle stapling tray 60. The saddle stapler 82 drives staples into bending portions of sheets that have been folded by a folding device 84. The sheets thus stapled are ejected to a second stacker tray 86.

Each of the sheet paths 50–58 is provided with transport rolls 87, which are connected to a driving motor via gears. The sheet transport speed can be varied by switching the rotation speed of the driving motor or providing a clutch. Each branching portion of the sheet paths 50–58 is provided with a switcher 89. A desired ejection destination can be selected by driving the switchers 89 by electromagnetic clutches or the like. Further, an offset device (not shown) is provided upstream of each of the top tray 62, the first stacker tray 80, and the second stacker tray 86 to enable adjustment of an offset direction (front, rear, straight, or the like).

Figure 3:
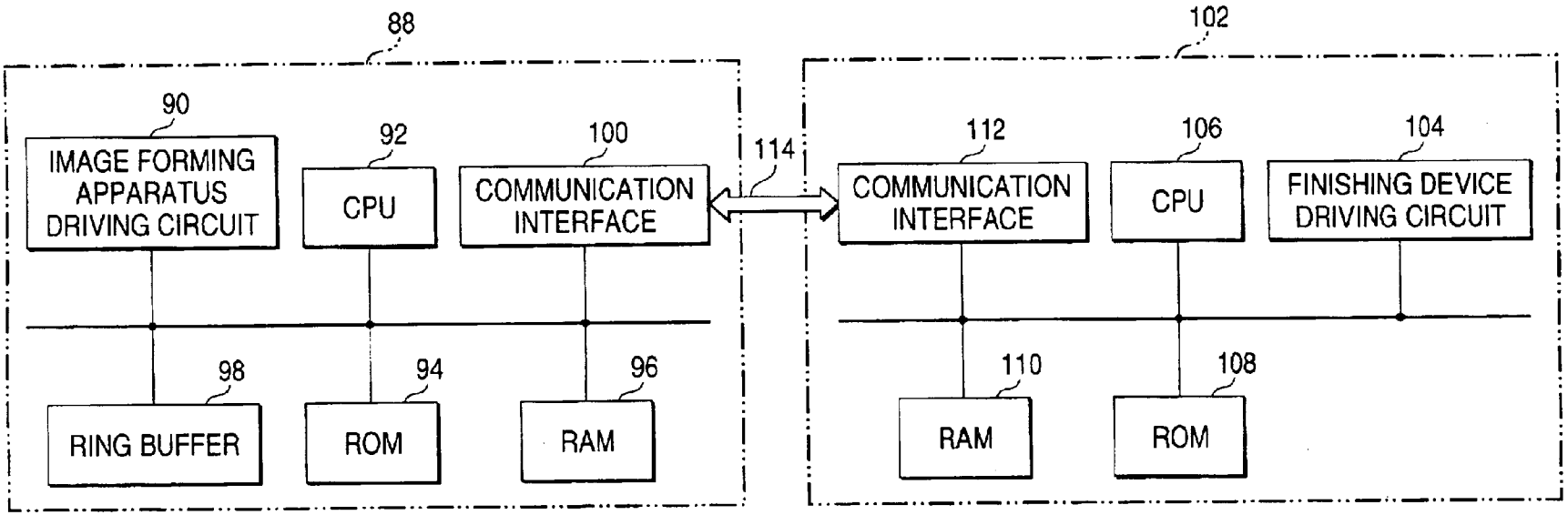
FIG. 3 is a block diagram showing control circuits of an image forming apparatus and the finishing device according to the embodiment of the invention.

As shown in FIG. 3, a control circuit 88 of the image forming apparatus 12 is formed by bus-connecting an image forming apparatus driving circuit 90, a CPU 92, a ROM 94, a RAM 96, a ring buffer 98, and a communication interface 100. The ring buffer 98 forms a FIFO memory. The image forming apparatus 12 is controlled by the CPU 92 according to a program that has been written to the ROM 94. On the other hand, a control circuit 102 of the finishing device 14 is formed by bus-connecting a finishing device driving circuit 104, a CPU 106, a ROM 108, a RAM 110, and a communication interface 112. The finishing device 14 is controlled by the CPU 106 according to a program that has been written to the ROM 108. The communication interface 100 of the image forming apparatus 12 and the communication interface 112 of the finishing device 14 are connected to each other by a communication cable 114 and hence can communicate with each other.

Figure 4:
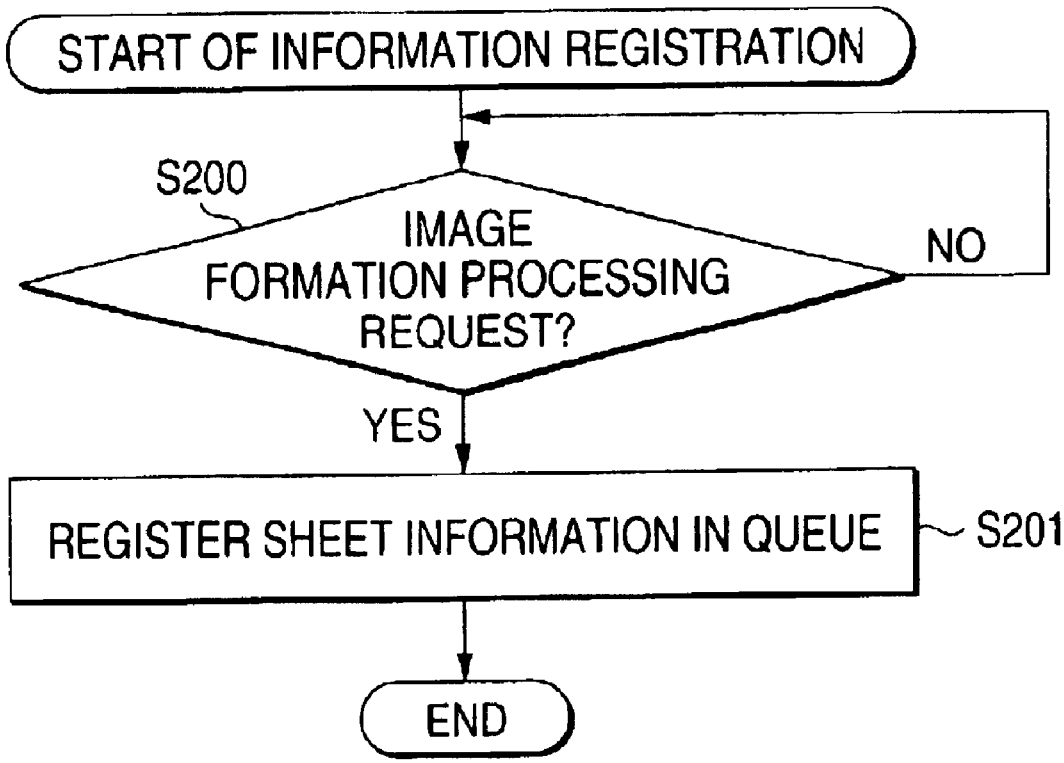
FIG. 4 is a flowchart showing a process of registering image formation processing information in the image forming apparatus according to the embodiment of the invention.
Figure 6:
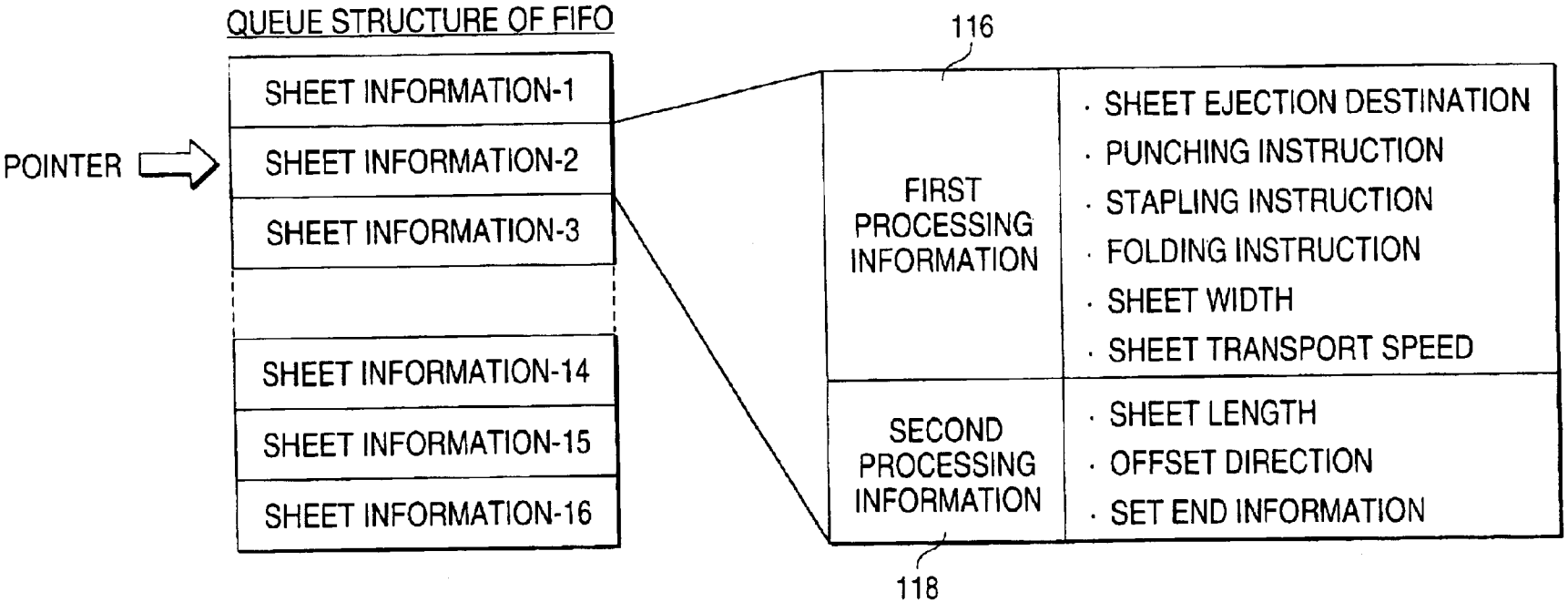
FIG. 6 shows a queue structure of a FIFO memory that is used in the image forming apparatus according to the embodiment of the invention.

FIG. 4 is a flowchart showing a process of registering image formation processing information in the image forming apparatus 12. At step S200, it is judged whether an image formation processing request has been received. An image formation processing request is to be sent from the user interface device 48. At step S200, waiting is made until input of an image formation processing request. If it is judged at step S200 that an image formation processing request has been received, the process goes to step S201, where sheet information is registered in a queue of the FIFO memory. As shown in FIG. 6, sheet information is registered for each sheet and made of first processing information 116 and second processing information 118. The first processing information 116 is information that is necessary for preparation in the finishing device 14, and hence is necessary before a sheet is ejected from the image forming apparatus 12. Specifically, the first processing information 116 includes a sheet ejection destination (the saddle stapling tray 60, top tray 62, compiler tray 64, or the like), a punching instruction (no, two holes, three holes, four holes, or the like), a stapling instruction (no, front, rear, dual, saddle, or the like), a folding instruction (no or folding), a sheet width, and a sheet transport speed. The second processing information 118 is information, other than the first processing information 116, that is necessary to perform the finishing operation and hence is necessary at a start of image formation. Specifically, the second processing information 118 includes a sheet length, an offset direction (front, rear, straight, or the like), and set end information (yes or no).

Figure 5:
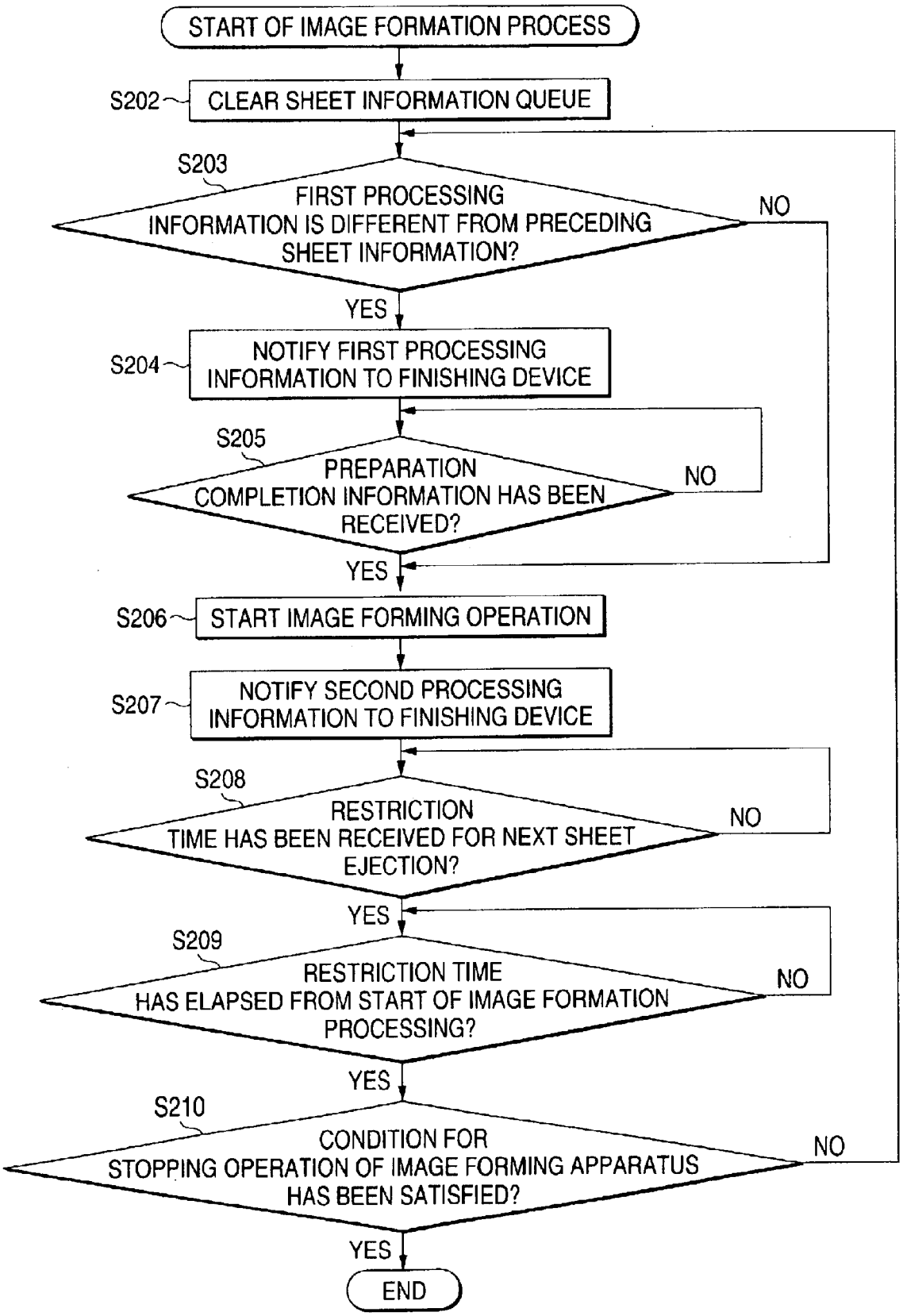
FIG. 5 is a flowchart showing a process relating to image formation processing judgments in the image forming apparatus according to the embodiment of the invention.

FIG. 5 is a flowchart showing a process relating to image formation processing judgments in the image forming apparatus 12. First, at step S202, the previously registered sheet information queue in the FIFO memory is cleared. New sheet information is input and the pointer is set to sheet information-1. The process goes to step S203, where it is judged whether the first processing information 116 of the new sheet information is different from that of the preceding sheet information. Step S203 is to monitor a change of the first processing information 116. If it is judged at step S203 that the two pieces of first processing information 116 are different from each other, the process goes to step S204, where the new first processing information 116 is notified to the finishing device 14 via the communication cable 114. Receiving the first processing information 116, the finishing device 14 makes preparation for the finishing operation. Specifically, for the sheet ejection destination information, the switchers 89 of the first sheet path 50 to the fifth sheet path 58 are switched, whereby one of the saddle stapling tray 60, the top tray 62, and the compiler tray 64 is selected. For the punching instruction, the puncher 66 is moved to the initial position. For the stapling instruction, the stapler 68 or the saddle stapler 82 is moved to the initial position. For the folding instruction, preparation of the folding device 84 is done. For the sheet width information, the tamper 78, for example, is moved to the home position for the sheet concerned. For the sheet transport speed information, preparation is done to switch the sheet transport speed by unit of the transport rolls 87. When the preparation for the finishing operation has completed, the finishing device 14 notifies preparation completion information to the image forming apparatus 12.

At step S205, it is judged whether preparation completion information has been received. The process does not go to the next step S206 and an image forming operation is prohibited until it is judged at step S205 that preparation completion information has been received. Upon reception of preparation completion information, the process goes to step S206, where the image forming operation is started. That is, controls are so made that the next sheet is fed from one of the sheet feed trays 16 to the print engine 22, image formation is performed by the print engine 22, and the sheet thus processed is sent to the finishing device 14.

If it is judged at step S203 that the first processing information 116 of the new sheet information is the same as that of the preceding sheet information, the process goes to-step S206 skipping steps S204 and S205. This is because no adjustment time for preparation is necessary in the finishing device 14 if no change exists in the first processing information 116.

At step S207, the second processing information 118 is notified to the finishing device 14. Receiving the second processing information 118, the CPU 106 of the finishing device 14 calculates, on the basis of the second processing information 118 and the first processing information 116 that was received at step S204 (the preceding one if no change exists in the first processing information 116), a restriction time that the finishing device 14 requires until ejection of the next sheet. In this embodiment, this restriction time is the shortest time during which the finishing device 14 can complete the finishing operation (from the ejection of the current sheet to the ejection of the next sheet), and is determined by the combination of the processing contents of the first processing information 116 and the second processing information 118. A processing time in the finishing device (a restriction time from the viewpoint of the image forming apparatus 12) is determined by the combination of the sheet ejection destination, the punching instruction, the stapling instruction, the folding instruction, the sheet width, the sheet transport speed, the sheet length, the offset direction, and the set end information. The calculation of a processing time may be performed by the CPU 92. It is also possible-to store processing times for all combinations in a nonvolatile memory in the form of a list.

Even for the same first processing information 116 and second processing information 118, the restriction time may have different values depending on the change of the internal environment of the finishing device 14, as exemplified below. Each of the saddle stapling tray 60 and the compiler tray 64 shown in FIG. 1 has a limitation in the number of sheets that can be accommodated there. The number of sheets that have been accommodated there is counted by a sensor. If it is judged that the number of accommodated sheets, that is, the count, exceeds the limitation number of the saddle stapling tray 60 or the compiler tray 64, the sheets accommodated there are moved to the first stacker tray 80 or the second stacker tray 86 and a restriction time that has been increased in consideration of time necessary for the movement is notified to the image forming apparatus 12. Another change in the internal environment of the finishing device 14 is overheat in the puncher 66, the stapler 68, the saddle stapler 82, or the like.

At the next step S208, it is judged whether a restriction time has been received for the next sheet ejection. The process does not go to step S209 and waiting is made until it is judged at step 208 that a restriction time has been received. At step S209, it is judged whether the restriction time has elapsed from the start of the image formation processing. The process does not go to step S210 and waiting is made until the restriction time elapses at step S209.

At the next step S210, it is judged whether a condition for stopping the operation of the image forming apparatus 12 has been satisfied. For example, the condition for stopping the operation of the image forming apparatus 12 is that the pointer of the FIFO memory 98 has passed the last sheet information and hence there remains no sheets on which to form an image or that a jam has occurred in the image forming apparatus 12 or the finishing device 14. If it is judged at step S210 that the stopping condition is not satisfied, the process returns to step S203. On the other hand, the process is finished if it is judged that the stopping condition is satisfied.

FIGS. 7–10 show various sequences of operations that are performed by the image forming apparatus 12 and the finishing device 14, which will be described below with additional reference to FIG. 5.

Figure 7:
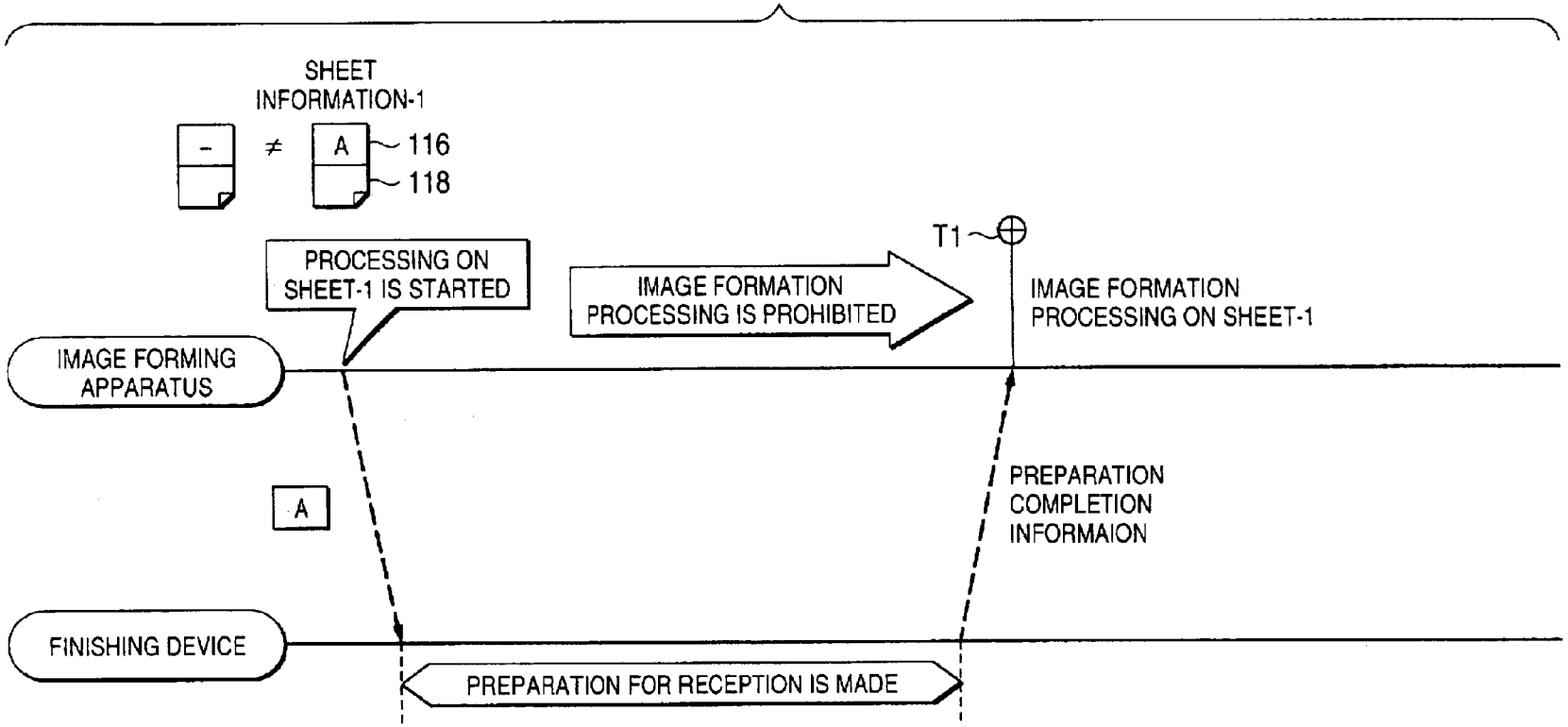
FIG. 7 is a sequence diagram showing a sequence of operations that are performed by the image forming apparatus and the finishing device according to the embodiment of the invention in ejecting the first sheet.

FIG. 7 shows a first state that the pointer of the FIFO memory is set to sheet information-1. In this state, the previous sheet information has been cleared and hence the first processing information 116 of the current sheet information, that is, sheet information-1, is different from that of the preceding sheet information. Therefore, the first processing information 116 of sheet information-1 is notified to the finishing device 14 (step S204). The finishing device 14 makes preparation for sheet reception on the basis of the received first processing information 116. When the preparation has completed, the finishing device 14 notifies preparation completion information to the image forming apparatus 12. It is noted that there is a case that the finishing device 14 can notify preparation completion information to the image forming apparatus 12 even before preparation completes actually. For example, preparation completion information may be notified by taking into consideration time to be taken from the start of image formation to sheet ejection and estimating when preparation will complete. If time to be taken to completion of preparation is within the time from the start of image formation to sheet ejection, preparation completion information can be notified immediately. In the image forming apparatus 12, the start of image formation processing is prohibited until reception of preparation completion information from the finishing device 14 (step S205). Upon reception of preparation completion information from the finishing device 14, image formation processing on sheet-1 is started (step S206). A time point when the image formation processing on sheet-1 is started is indicated by symbol T1 in FIG. 7.

Figure 8:
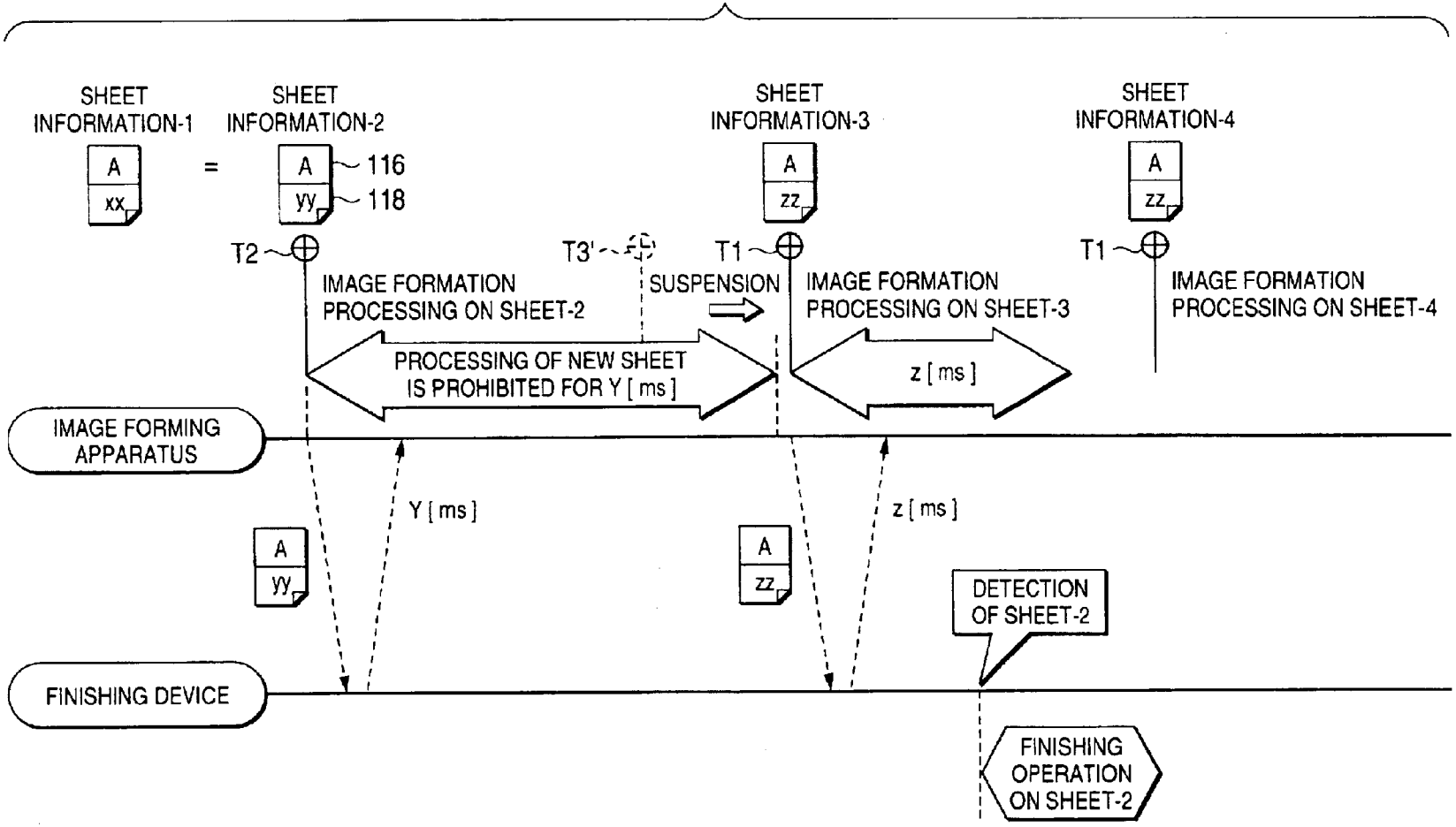
FIG. 8 is a sequence diagram showing a sequence of operations that are performed by the image forming apparatus and the finishing device according to the embodiment of the invention in a case that first processing information remains the same from sheet information-1 to sheet information-4.

FIG. 8 shows a sequence of operations that are performed in a case that the first processing information 116 does not change from sheet information-1 to sheet information-4. Since the first processing information 116 of sheet information-2 is the same as that of sheet information-1, steps S204 and S205 are skipped and image formation processing on sheet-2 is started (step S206). At the same time, the second processing information 118 is notified to the finishing device 14 (step S207). A time point when the image formation processing on sheet-2 is started is indicated by symbol T2 in FIG. 8. Although the first processing information 116 has already been notified to the finishing device 14 as part of sheet information-1, the first processing information may be notified again at step 207 together with the second processing information 118. The finishing device 14 calculates a restriction time y (ms) on the basis of the first processing information 116 and the second processing information 118, and notifies it to the image forming apparatus 12. The image forming apparatus 12 prohibits start of image formation processing on sheet-3 until passage of the restriction time y (ms) (step S209). If the restriction time y (ms) is longer than an ordinary ejection interval of the image forming apparatus 12, the start of the image formation processing is delayed beyond a time point corresponding to the ordinary ejection interval, that is, the image formation processing is started after a lapse of the restriction time y (ms), so that the finishing operation will be performed normally. An image formation time point of sheet-3 that is determined by only the productivity of the image forming apparatus 12 is indicated by symbol T3' (phantom line) in FIG. 8. According to the embodiment, the image formation processing is not started until a lapse of the restriction time y (ms); the image formation processing is started actually on sheet-3 at a time point T3 when the prohibition of the processing is canceled. Since sheet information-2 and sheet information-3 have the same first processing information 116, the image forming apparatus 12 likewise notifies sheet information-3 to the finishing device 14 at the same time as starts the image formation processing on sheet-3. The finishing device 14 calculates a restriction time z (ms) and notifies it to the image forming apparatus 12. If the restriction time z (ms) is shorter than the ordinary ejection interval of the image forming apparatus 12, image formation processing on sheet-4 is started at a time point T4 after a lapse of the ordinary interval.

Figure 9:
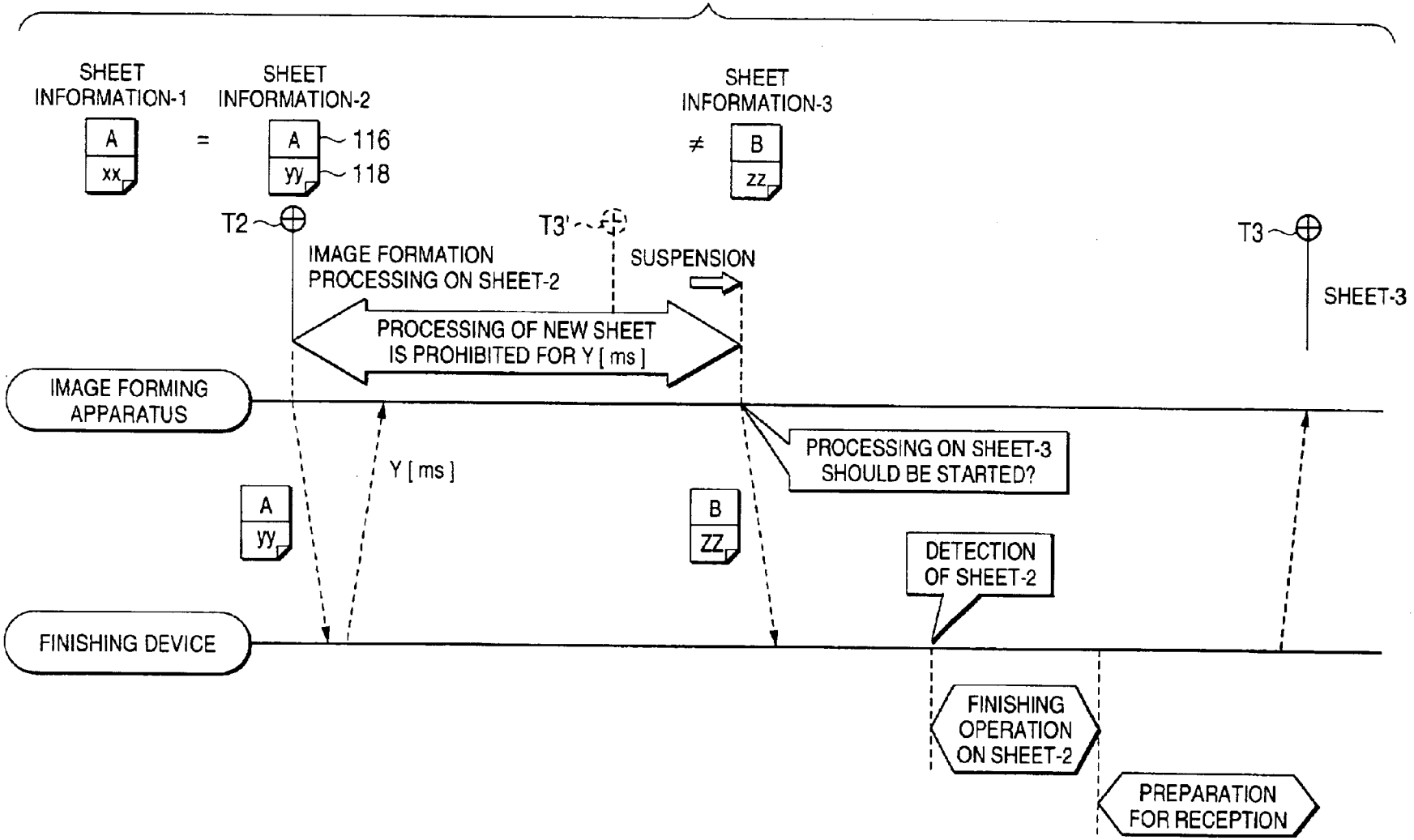
FIG. 9 is a sequence diagram showing a sequence of operations that are performed by the image forming apparatus and the finishing device according to the embodiment of the invention in a case that sheet information-2 and sheet information-3 have different pieces of first processing information.

FIG. 9 shows a sequence of operations that are performed in a case that sheet information-1 and sheet information-2 have the same first processing information 116 but sheet information-2 and sheet information-3 have different pieces of first processing information 116. Since the first processing information 116 of sheet information-2 is the same as that of sheet information-1, the image forming apparatus 12 notifies the second processing information 118 on sheet-2 to the finishing device 14 (step S207) at the same time as starts image formation processing on sheet-2 (step S206). The finishing device 14 calculates a restriction time y (ms) on the basis of the first processing information 116 and the second processing information 118, and notifies it to the image forming apparatus 12. The image forming apparatus 12 prohibits start of image formation processing on sheet-3 until passage of the restriction time y (ms) (step S209). As in the case of the example of FIG. 8, an image formation time point of sheet-3 that is determined by only the productivity of the image forming apparatus 12 is time T3' (indicated by a phantom line in FIG. 9). According to the embodiment, the image formation processing is not started until a lapse of the restriction time y (ms). After a lapse of the restriction time y (ms), it is judged whether the first processing information 116 of sheet information-3 is the same as that of sheet information-2 (step 203). Since they are different from each other, the first processing information 116 of sheet information-3 is notified to the finishing device 14 (step S204) before a start of image formation processing. The finishing device 14 performs a finishing operation on sheet-2 and prepares for reception of sheet-3. Upon completion of the preparation for reception of sheet-3, the finishing device 14 notifies preparation completion information to the image forming apparatus 12. The image forming apparatus 12 starts image formation processing on sheet-3 at time T3. However, if judging that no preparation for reception is necessary, the finishing device 14 notifies preparation completion information immediately. Therefore, whether to prepare for reception can be determined on the basis of only factors on the finishing device 14 side and the image forming apparatus 12 is required to only wait for completion of the preparation of the finishing device 14; the image forming apparatus 12 and the finishing device 14 can be made highly independent of each other.

In this embodiment, sheet information-3 is compared with sheet information-2 after a lapse of the restriction time y (ms). Another embodiment may be such that sheet information-3 is compared with sheet information-2 in the interval of the restriction time y (ms). In this case, the image formation processing on sheet-3 can be started immediately after a later one of a lapse the restriction time y (ms) and completion of the preparation.

Figure 10:
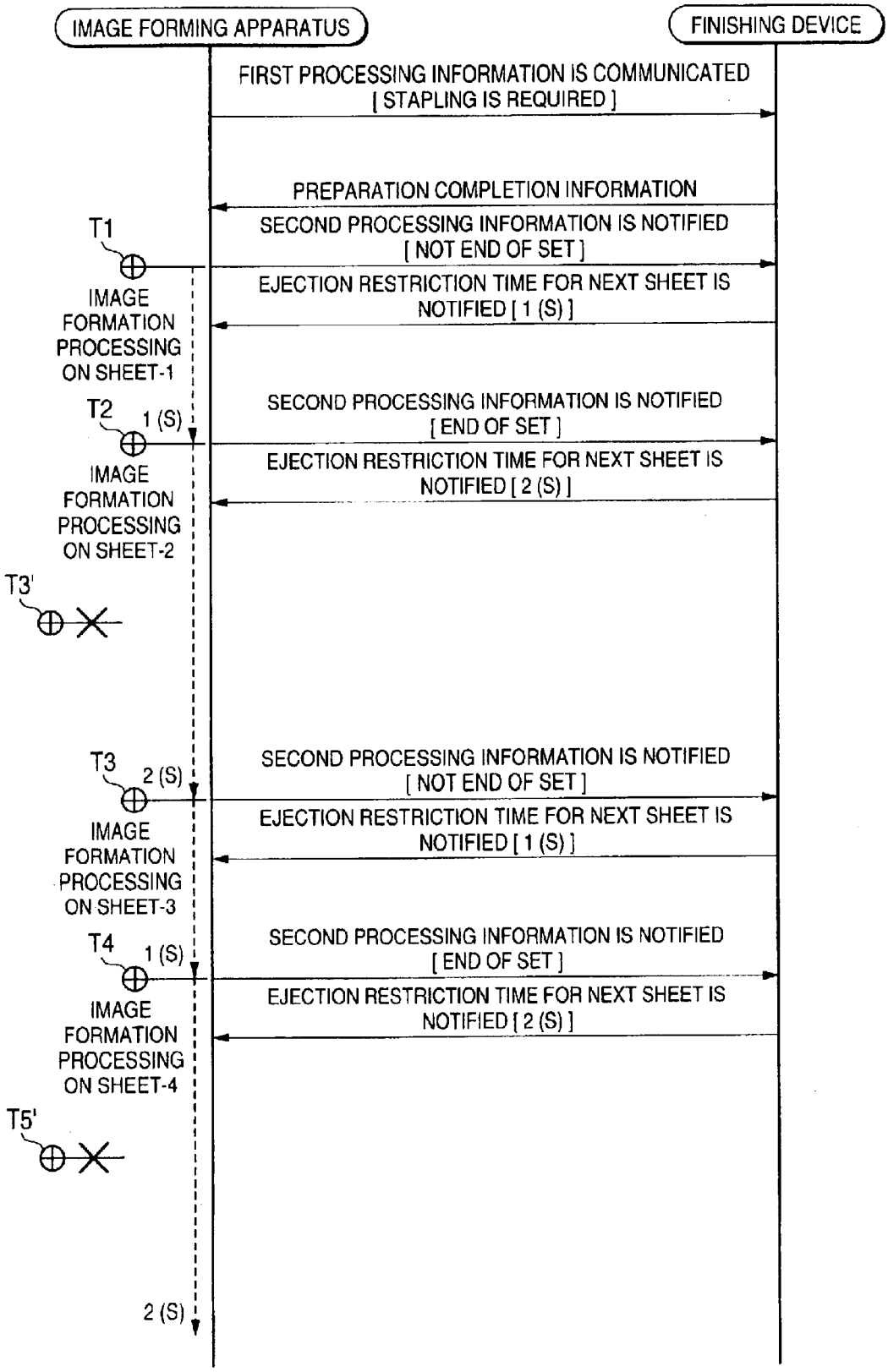
FIG. 10 is a sequence diagram showing a sequence of operations that are performed by the image forming apparatus and the finishing device according to the embodiment of the invention in forming two sets of two A4-sheets stapled together.

FIG. 10 shows a sequence of operations that are performed in forming two sets of two A4-sheets stapled together. First, information indicating that the sheet width is the A4 width and stapling should be performed is notified from the image forming apparatus 12 to the finishing device 14 as first processing information of sheet information-1 (step S204). Receiving this information, the finishing device 14 moves the stapler main body 70 and the tamper 78 (see FIG. 2) to the home positions for A4-sheets. After completion of the movement, the finishing device 14 notifies preparation completion information to the image forming apparatus 12. Receiving that information, the image forming apparatus 12 starts image formation processing on sheet-1 (step S206) and, at the same time, notifies, to the finishing device 14, second processing information to the effect that the end of the set has not been reached yet (step S207). Receiving the second processing information, the finishing device 14 performs calculation to determine a restriction time (e.g., 1 (s)) that will be taken from the start of the image formation processing to reception of sheet-2 by the compiler tray 64 and notifies it to the image forming apparatus 12. Since 1 (s) is within the ordinary ejection interval, the image forming apparatus 12, starts image formation processing on sheet-2 with the ordinary ejection interval (step S206). At the same time, the image forming apparatus 12 notifies, to the finishing device 14, second processing information of sheet information-2 to the effect that end of the set has been reached (step S207). The processing interval between sheet-1 and sheet-2 is determined by only the productivity of the image forming apparatus 12, and hence the image formation on sheet-2 is started at an ordinary image formation start time point T2. However, for sheet-3, it is necessary to take into consideration time that is necessary to staple sheet-1 and sheet-2 together. Therefore, time necessary for a finishing operation is calculated as 2 (s), for example, and is notified to the image forming apparatus 12. Since, in the image forming apparatus 12 receiving the calculated time, 2 (s) is longer than the ordinary image formation interval, an ordinary image formation start time point T3' for sheet-3 is skipped and image formation on sheet-3 is started at a time point T3 that is delayed from T3' by one ordinary image formation interval. Sheet-4 is handled in the same manner as sheet 2. For sheet-5, an ordinary image formation start time point T5' is skipped by one.

According to this embodiment, time that will be taken until reception of the next sheet becomes possible is notified to the image forming apparatus 12 for each sheet. Therefore, even when jobs are given continuously, they can be handled continuously by performing a control in such a manner that sheet information of each job is divided into pieces of sheet information of individual sheets. It is also possible to accommodate a case that the internal environment of the finishing device 14 varies not in an interval between sets and it is necessary to change the processing time of the finishing device 14 accordingly.

In this embodiment, the time management relating to the second processing information is performed by the image forming apparatus 12. It is also possible to give a time managing function to the finishing device 14 and to cause the finishing device 14 to notify time lapse information to the image forming apparatus 12 after a lapse of a time set.

Figure 11:
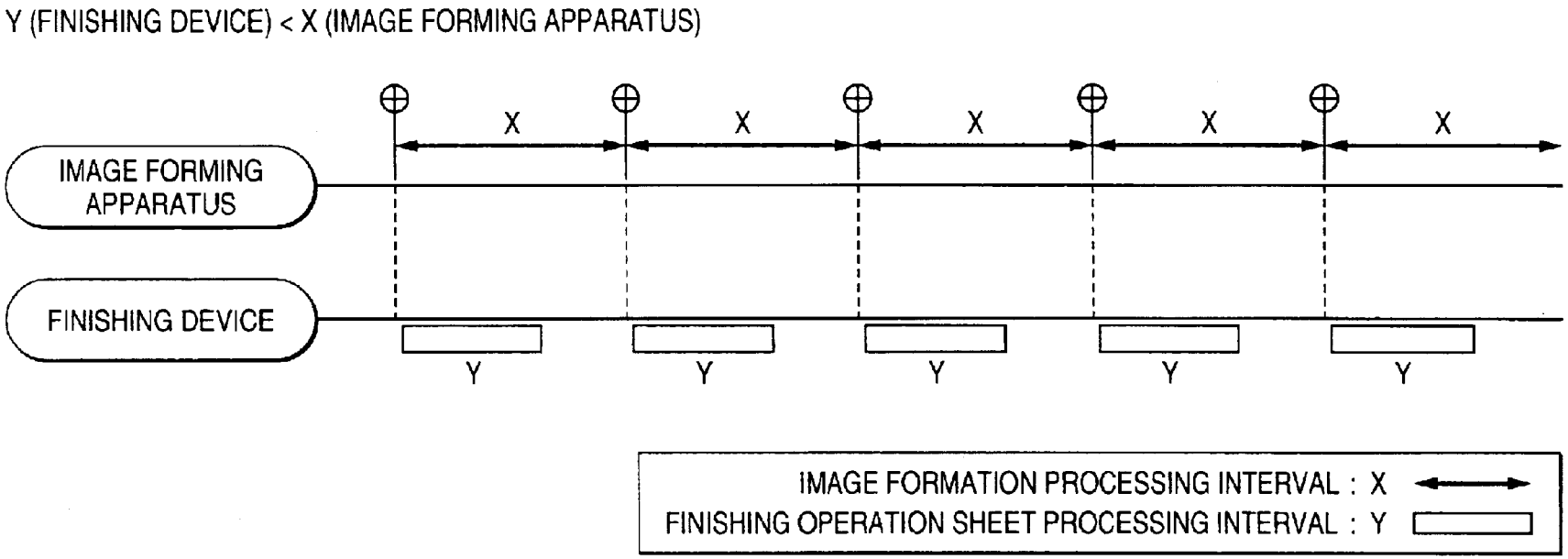
FIG. 11 is a sequence diagram showing a sequence of operations that are performed by the image forming apparatus and the finishing device according to the embodiment of the invention in a case that the finishing device is higher in productivity than the image forming apparatus.
Figure 12:
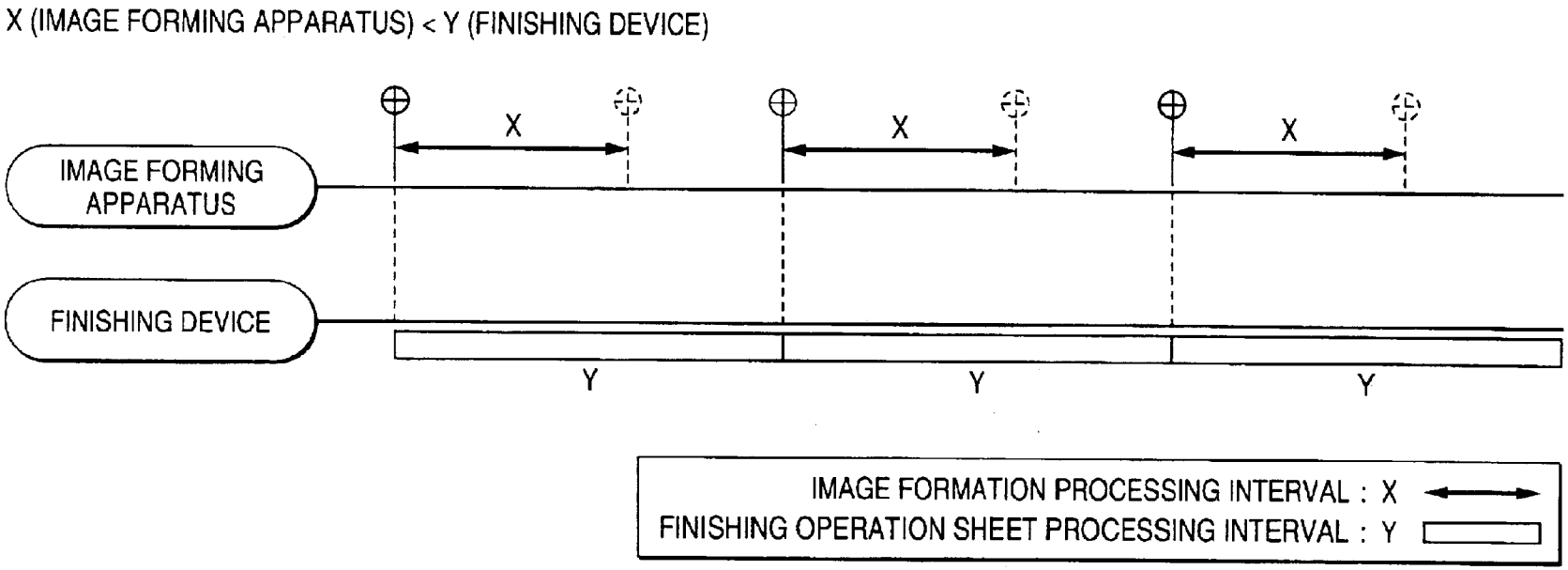
FIG. 12 is a sequence diagram showing a sequence of operations that are performed by the image forming apparatus and the finishing device according to the embodiment of the invention in a case that the finishing device is lower in productivity than the image forming apparatus.

FIGS. 11 and 12 show relationships between the productivity of the image forming apparatus 12 and that of the finishing device 14. As shown in FIG. 11, in the case where the finishing operation sheet processing interval Y is shorter than the image formation processing interval X, that is, the finishing device 14 is higher in productivity than the image forming apparatus 12 (Y<X), the image forming apparatus 12 can perform image formation processing on sheets at the ordinary ejection intervals X and the system operates according to the productivity (processing ability) of the image forming apparatus 12. On the other hand, as shown in FIG. 12, in the case where the image forming apparatus 12 is higher in productivity than the finishing device 14 (X<Y), the image forming apparatus 12 performs image formation processing at the finishing operation sheet processing intervals Y and the system operates according to the productivity (processing ability) of the finishing device 14. In either case, the productivity of the image forming apparatus 12 or the finishing device 14 can be fully utilized.

It is possible to provide the finishing device 14 with a mechanical unit for matching the productivity of the finishing device 14 with that of the image forming apparatus 12. For example, where the image forming apparatus 12 is higher in productivity than the finishing device 14, switching may be made so as to increase the sheet transport speed of the finishing device 14 as described in the above embodiment or a plurality of compiler trays may be provided and used cyclically (or alternately) as described in JP-B-5-41991.

The above embodiment is directed to the case of using the finishing device 14. Another embodiment is possible in which the same concept is applied to a combination of an image forming apparatus and a document reading device. Where the interval of the document reading processing is shorter than the interval of the image formation processing, that is, the document reading device is higher in productivity than the image forming apparatus, the image forming apparatus can perform image formation processing on sheets at the ordinary sheet ejection intervals and the system operates according to the productivity of the image forming apparatus. On the other hand, where the image forming apparatus is higher in productivity than the finishing device, the image forming apparatus performs image formation processing at the same intervals as the document reading processing intervals of the document reading device and the system operates according to the productivity (processing ability) of the document reading device. In either case, the productivity of the image forming apparatus or the document reading device can be fully utilized. In this manner, a document reading device and an image forming apparatus that are different from each other in productivity can be combined with each other.

Still another embodiment is possible in which the invention is applied to a combination of image formation processing of an image forming apparatus and sheet feed processing of a sheet feed tray. According to this embodiment, a controller for the image forming apparatus and a controller for the sheet feed processing are provided and perform controls independently. Connected to each other by a communication cable, the controllers exchange information for image formation. Where the interval of the sheet feed processing is shorter than the interval of the image formation processing, that is, the sheet feed device is higher in productivity than the image forming apparatus, the image forming apparatus can perform image formation processing on sheets at the ordinary intervals and the system operates according to the productivity of the image forming apparatus. On the other hand, where the sheet feed device is lower in productivity than the image forming apparatus, the system operates according to the productivity of the sheet feed device.

According to this embodiment, image forming processing and sheet feed processing that are different from each other in productivity can be combined with each other.

Further, this embodiment can optimize the productivity in accordance with a sheet feed tray attached. More specifically, the productivity can be optimized in accordance with a sheet feed tray that has been selected in an image forming operation. For example, the productivity can be optimized in a case that switching is made sheet by sheet among sheet feed trays in a sheet feed device that uses, in mixture, a sheet feed tray having a feed head that separates a sheet using air and hence activation takes a relatively long time and a sheet feed tray having an ordinary feed head that separates a sheet using a roll.

The above embodiments are directed to the combination of the image forming apparatus and the finishing device, the combination of the image forming apparatus and the document reading device, and the combination of the image forming apparatus and the sheet feed device, respectively. The invention encompasses a combination of (part of) these combinations. In this case, control is so made that the system is given optimum productivity by comparing the degrees of productivity of the constituent combinations.

As described above, according to the invention, in the peripheral device for an image forming apparatus, the peripheral device receives information that is necessary for processing in the peripheral device, generates information relating to a processing time of the peripheral device, and notifies it to the image forming apparatus. Therefore, in the image forming apparatus, the load of managing restrictive conditions resulting from a difference in productivity from the peripheral device can be reduced.

The image forming apparatus notifies, to the peripheral device, information that is necessary for processing in the peripheral device, receives information generated by the peripheral device, and then controls an image forming operation. It is appropriate for the image forming apparatus to wait for sending of information from the peripheral device and then control an image forming operation. The load of control can thus be reduced.

Further, in the image forming system, the image forming apparatus notifies information that is necessary for a finishing operation to the peripheral device, the peripheral device generates information that is necessary for an image forming operation, and the image forming apparatus receives this information and controls its image forming operation. This makes it possible to combine an image forming apparatus and a peripheral device freely, to selectively delete part of the functions of the peripheral device or add new functions, and to secure high productivity for the system.

The entire disclosure of Japanese Patent Application No. 2001-229267 filed on Jul. 30, 2001 including specification, claims, drawings and abstract is incorporated herein by reference in its entirety.

What is claimed is:

1. An image forming apparatus to which a peripheral device is to be connected, comprising:

notifying means for notifying the peripheral device of information that is necessary for the peripheral device to perform a processing control;

receiving means for receiving information relating to a processing time of the peripheral device, the information having been generated on the basis of the information notified by the notifying means; and control means for controlling an image forming operation on the basis of the information received by the receiving means, wherein the notifying means separately notifies of first processing information that is necessary for the peripheral device to prepare for processing and second processing information that is necessary for the peripheral device to perform the processing, the second processing information excluding the first processing information, wherein the receiving means receives preparation completion information as a response to the first processing information and receives information relating to a processing time as a response to the second processing information, and wherein the control means prohibits a new image forming operation until a later one of reception of the preparation completion information and a lapse of the processing time.

2. The image forming apparatus according to claim 1, wherein the peripheral device is a finishing device for performing a finishing operation on a sheet that is ejected from the image forming apparatus, and wherein the receiving means receives information relating to time that will be taken until reception of the sheet becomes possible.

3. The image forming apparatus according to claim 1, wherein the notifying means notifies information relating to a first sheet on which an image will be formed, the receiving means receives information relating to a second sheet that will follow the first sheet to be subjected to image formation, and the control means controls an image forming operation on the second sheet.

4. The image forming apparatus according to claim 1, further comprising monitoring means for monitoring a change in the first processing information, and the notifying means notifies only of the second processing information if the monitoring means judges that the first processing information has not changed.

5. The image forming apparatus according to claim 1, further comprising monitoring means for monitoring a change in the first processing information, and the notifying means notifies of the first processing information and the second processing information if the monitoring means judges that the first processing information has changed.

6. An image forming system having an image forming apparatus for forming an image on a sheet and a peripheral device connected to the image forming apparatus, comprising:

first communicating means for sending information that is necessary for the peripheral device to perform a processing control from the image forming apparatus to the peripheral device;

information generating means, provided in the peripheral device, for generating information relating to a processing time of the peripheral device on the basis of the information received by the peripheral device;

second communicating means for sending the information generated by the information generating means from the peripheral device to the image forming apparatus; and control means, provided in the image forming apparatus, for controlling an image forming operation on the basis of the information received by the image forming apparatus, wherein the first communicating means sends, from the image forming apparatus to the peripheral device, first processing information that is necessary for the peripheral device to prepare for processing and second processing information that is necessary for the peripheral device to perform the processing, the second processing information excluding the first processing information, wherein the information generating means generates preparation completion information on the basis of the first processing information when the preparation has completed, and generates information relating to a processing time on the basis of the first processing information and the second processing information, and wherein the control means prohibits a new image forming operation until a later one of reception of the preparation completion information and a lapse of the processing time.

7. The image forming system according to claim 6, wherein the peripheral device is a finishing device for performing a finishing operation on a sheet that is ejected from the image forming apparatus, and wherein the information generating means generates information relating to time that will be taken until reception of the sheet becomes possible.

8. The image forming system according to claim 6, wherein the first communicating means sends information relating to a first sheet on which an image will be formed by the image forming apparatus, and the information generating means generates information that is necessary for an image formation control on a second sheet that will follow the first sheet to be subjected to image formation.

9. The image forming system according to claim 6, wherein the control means prohibits a new image forming operation until a processing time included in the information received by the image forming apparatus is lapsed.

10. The image forming system according to claim 6, further comprising monitoring means for monitoring a change in the first processing information, and the first communicating means sends only the second processing information if the monitoring means judges that the first processing information has not changed.

11. The image forming system according to claim 6, further comprising monitoring means for monitoring a change in the first processing information, and the first communicating means sends the first processing information and the second processing information if the monitoring means judges that the first processing information has changed.

12. A control method of an image forming system having an image forming apparatus for performing image formation on a sheet and a peripheral device connected to the image forming apparatus, comprising the steps of:

sending, from the image forming apparatus to the peripheral device, information that is necessary for the peripheral device to perform processing;

generating processing time information relating to a processing time of the peripheral device on the basis of the information sent to the peripheral device, and generating preparation completion information relating to completion of a preparation of the peripheral device;

sending the processing time information and preparation completion information from the peripheral device to the image forming apparatus; and controlling an image forming operation on the basis of the information sent to the image forming apparatus, prohibiting a new image forming operation until a later one of reception of the preparation completion information and a lapse of the processing time.

13. The image forming apparatus according to claim 12, wherein the peripheral device is a finishing device for performing a finishing operation on a sheet that is ejected from the image forming apparatus, and further comprising generating information relating to a time that will be taken until reception of the sheet becomes possible.

14. The image forming apparatus according to claim 13, further comprising generating information relating to a first sheet on which an image will be formed, and information relating to a second sheet that will follow the first sheet to be subjected to image formation, and controlling an image forming operation on the second sheet.

15. An image forming apparatus to which a peripheral device is to be connected, comprising:

notifying means for notifying the peripheral device of information that is necessary for the peripheral device to perform a processing control;

receiving means for receiving information relating to a processing time of the peripheral device, the information having been generated on the basis of the information notified by the notifying means; and control means for controlling an image forming operation on the basis of the information received by the receiving means, wherein the notifying means separately notifies first processing information that is necessary for the peripheral device to prepare for processing and second processing information that is necessary for the peripheral device to perform the processing, the second processing information excluding the first processing information, and further comprising monitoring means for monitoring a change in the first processing information, and the notifying means notifies only the second processing information if the monitoring means judges that the first processing information has not changed.

16. The image forming apparatus according to claim 15, further comprising monitoring means for monitoring a change in the first processing information, and the notifying means notifies of the first processing information and the second processing information if the monitoring means judges that the first processing information has changed.

17. An image forming apparatus to which a peripheral device is to be connected, comprising:

notifying means for notifying the peripheral device of information that is necessary for the peripheral device to perform a processing control;

receiving means for receiving information relating to a processing time of the peripheral device, the information having been generated on the basis of the information notified by the notifying means; and control means for controlling an image forming operation on the basis of the information received by the receiving means, wherein the control means prohibits a new image forming operation until a later one of reception of a preparation completion information and a lapse of the processing time.

18. An image forming system having an image forming apparatus for forming an image on a sheet and a peripheral device connected to the image forming apparatus, comprising:

first communicating means for sending information that is necessary for the peripheral device to perform a processing control from the image forming apparatus to the peripheral device;

information generating means, provided in the peripheral device, for generating information relating to a processing time of the peripheral device on the basis of the information received by the peripheral device;

second communicating means for sending the information generated by the information generating means from the peripheral device to the image forming apparatus; and control means, provided in the image forming apparatus, for controlling an image forming operation on the basis of the information received by the image forming apparatus, wherein the first communicating means sends, from the image forming apparatus to the peripheral device, first processing information that is necessary for the peripheral device to prepare for processing and second processing information that is necessary for the peripheral device to perform the processing, the second processing information excluding the first processing information, and further comprising monitoring means for monitoring a change in the first processing information, and the first communicating means sends only the second processing information if the monitoring means judges that the first processing information has not changed.

* * * * *